US008272329B1

(12) United States Patent
Hsieh et al.

(10) Patent No.: US 8,272,329 B1
(45) Date of Patent: Sep. 25, 2012

(54) SELECTABLE LETHALITY WARHEAD PATTERNED HOLE FRAGMENTATION INSERT SLEEVES

(75) Inventors: Henry Hsieh, Riverdale, NJ (US); Peter Rottinger, Vernon, NJ (US); Richard Fong, Boonton Township, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/192,588

(22) Filed: Jul. 28, 2011

(51) Int. Cl.
*F42B 12/22* (2006.01)

(52) U.S. Cl. ..... 102/491; 102/492; 102/494; 102/389

(58) Field of Classification Search ..... 102/491, 102/492, 494, 389
See application file for complete search history.

(56) References Cited

U.S. PATENT DOCUMENTS 3,977,327 A * 8/1976 Brumfield et al. ..... 102/494
5,337,673 A * 8/1994 Koontz et al. ..... 102/491
7,066,093 B2 * 6/2006 Ronn et al. ..... 102/489
7,891,297 B1 * 2/2011 Rohr ..... 102/492
8,161,884 B1 * 4/2012 Kokodis et al. ..... 102/493
2010/0282115 A1 * 11/2010 Sheridan et al. ..... 102/491

* cited by examiner

*Primary Examiner* — J. Woodow Eldred
(74) *Attorney, Agent, or Firm* — Michael C. Sachs

(57) ABSTRACT

The dynamically configurable controlled fragmentation insert mechanism of this invention includes an assembly of three or more sleeves with differing through hole patterns thereon, that fit inside the shell casing. The individual sleeves can move independently of one another and a simple pinning mechanism holds the parts in place for a selected configuration. The warfighter can realign the insert sleeves by to create different geometric patterns of holes, each designed to engage a different target set with optimally sized fragments. The aligned patterns of holes creates individual geometric shapes that focus high-velocity jets to cut into the steel shell casing to correlate to the through-holes in the aligned patterned sleeves. Realigning the insert sleeves changes the through-hole pattern to produce different fragment sizes and mass distributions. To defeat light armored vehicles for instance, a warfighter can deploy a sleeve hole pattern to produce larger fragments with greater penetrating power, while to engage enemy troops for instance, a warfighter can "dial in" another hole pattern through the fuze assembly to otherwise produce a much larger number of smaller, lighter fragments.

10 Claims, 3 Drawing Sheets

SELECTABLE LETHALITY WARHEAD PATTERNED HOLE FRAGMENTATION INSERT SLEEVES

GOVERNMENT INTEREST

The inventions described herein may be made, used, or licensed by or for the U. S. Government for U. S. Government purposes.

BACKGROUND OF INVENTION

To destroy a specific target of a defined armor protection and size, a given fragmentation warhead must deliver a large number of optimally sized fragments within an effective lethal area. To combat multiple threat scenarios, the U.S. military must maintain supplies of several different fragmentation warheads, each type adapted for use against a particular target set. This obligatory approach creates a burden on logistics and supply. Additionally, existing artillery and mortars produce limited lethality depending upon the grade of steel used in their shells. Making more lethal, multi-purpose munitions available to the military would result in significant inventory reductions and cost savings.

The U.S. military employs fragmentation warheads against a wide variety of targets ranging from personnel, radar systems, trucks, parked aircraft, and rocket launchers to armored personnel carriers .and self-propelled artillery. One significant obstacle to mission success is that a fragmentation warhead designed to defeat personnel is not generally effective against materiel targets including trucks and light armored vehicles, where fragments of relatively greater size and mass are required. As mentioned, military units must maintain supplies of several different fragmentation warheads, each type adapted for use against a particular type of target. This results in a burden on logistics and supply.

Existing artillery and mortars produce limited lethality depending upon the grade of steel used in their shells. Warhead designers have tried several techniques to enhance fragmentation including: using harder High Fragmentation (HF) steel in the shell body, scoring the shell body, adding preformed fragments, and applying multiple detonator initiation schemes. While these techniques can improve lethality, each traditional approach presents its own problems. Manufacturing HF steel involves a time consuming and costly heat treatment process. Scoring the casing weakens the shell's structural rigidity presenting potential problems related to survivability. Specifically, the scored grooves act as stress concentration points during the set back stage of gun launch. Adding preformed fragments helps to assure that the warhead delivers a few optimally sized fragments but fails to enhance the fragmentation of the existing shell casing. Multiple detonator initiation schemes are very complicated and the additional detonators reduce the amount of space available for high explosive material.

To effectively engage multiple target types, the U.S. military requires an easily producible, multi-mode warhead alternative at a reasonable cost. Described here to meet this challenge is a high performance variable lethality, multi-purpose warhead using a novel adaptive fragmentation mechanism. The invention enables the modern warfighter to instantaneously modify a fragmentation warhead in the field, generating a desired fragment size to neutralize a broad range of targets, from personnel targets to light armored vehicles. Additionally, adaptive fragmentation can minimize collateral damage by focusing the warhead's lethal effects upon the intended targets.

This invention can increase lethality by fitting conventional fragmentation warheads with inexpensive, dynamically configurable patterned insert sleeve mechanisms, to control the fragment mass distribution.

BRIEF SUMMARY OF THE INVENTION

The dynamically configurable controlled fragmentation insert mechanism of this invention includes an assembly of three or more sleeves that fit inside the shell casing. The innermost sleeve contains the explosive material and eliminates voids that could adversely affect performance or even initiate premature detonation during launch. The explosive material comprises, for example, LX-14, OCTOL, hand packed C-4, or any other solid explosive that might be machined, cast, or hand-packed to fit snugly within the inside of the innermost sleeve. The dynamically selectable hole pattern is made up of two or more additional sleeves, each perforated with a unique pattern of holes. Each sleeve is designed to fit inside the next. The individual sleeves can move independently of one another and a simple pinning mechanism holds the parts in place for a selected configuration. The warfighter can realign the insert sleeves by manipulating the fuze assembly to create different geometric patterns of holes, each designed to engage a different target set with optimally sized fragments. The insert pattern of holes creates individual geometric shapes that focus the explosive energy released upon detonation to generate multiple high-velocity jets. The jets cut into the steel shell casing in the predefined areas that correlate to the through-holes in the aligned patterned sleeves. This solution makes efficient use of the high velocity radial expansion of the shell initiated upon detonation. The selectable pattern of insert sleeve holes focuses the explosive energy and forces the shell body to break up in a predictable fashion. Realigning the insert sleeves changes the through-hole pattern to produce different fragment sizes and mass distributions. The aligned through-holes focus the explosive energy at specific points on the inside of the shell casing and the blocked holes limit the expansion, allowing warhead designers to precisely control the fragment geometry. To defeat light armored vehicles or other materiel targets, the warfighter can deploy the warhead without changing the default mechanical offset of the insert sleeve hole pattern to produce larger fragments with greater penetrating power, or to engage enemy troops, the warfighter can easily "dial in" the hole pattern through the fuze assembly to otherwise configure a much larger number of smaller, lighter fragments. Now, the warfighter can instantaneously configure one warhead in the field to engage multiple target types. The invention functions by focusing the explosive energy released upon detonation into a series of high velocity jets, much like the action of shaped charges. The jets cut into the shell body breaking it into smaller pieces. The alignment of the patterned sleeves, the number of sleeves, the pattern/frequency and size of the holes, and the geometry of the holes can be modified to produce different combinations of large and small sized fragments. The sleeve can be made out of a variety of low-cost, easily machined materials including metals and plastics. This new patterned hole insert sleeve assembly addresses the downfalls of the existing fragmentation enhancement methods in the following ways:

1. The insert sleeve assembly requires no modifications to the existing projectile body and this novel solution easily conforms to both cylindrical and non-cylindrical shell casings including tapered mortar bodies and round grenades.

2. Manufacturers can mass produce the simple patterned hole insert sleeves for low cost using casting, stamping, or rolling methods and inexpensive materials including metals and plastics. The basic patterned hole fragmentation design calls for fabricators to manufacture just three simple insert sleeves with easily mass produced tolerances compared to other fragmentation insert designs that require a multitude of intricate machined parts with high tolerance specifications. To produce the patterned hole fragmentation inserts, makers can simply punch holes in sheet metal and then roll the sheets up into sleeves.

3. This unique mechanism enhances the fragmentation of the entire existing shell body. Unlike traditional fragmentation approaches that fail to utilize all of the shell body material, this optimal new design can also form engineered fragments out of the warhead detonator cap and the end cap, ultimately increasing lethality.

4. This innovative control fragmentation mechanism can dynamically tailor the fragment masses, shapes, and distribution for the best possible performance. This device ensures optimal lethality against both materiel and personnel.

5. The warfighter can quickly configure the fragmentation mode in the field easily and reliably by simply rotating the sleeves through the fuze assembly. This single step operation is straightforward and easy compared to moving multiple parts in other fragmentation insert devices.

6. Warhead designers can easily apply this new scalable concept to enhance the lethality of munitions ranging in size from grenades through mortar and artillery rounds up to tactical missiles.

This adaptive fragmentation will benefit the modern warfighter because warhead engineers can retrofit existing projectiles using this multi-mode controlled fragmentation assembly without modifying the shells. This simple new technology will also serve the U.S. military far into the future as engineers apply this scalable concept to new munition designs ranging in size from grenades through mortar and artillery rounds up to tactical missiles. Additionally, future warhead designs could easily incorporate a mechanism to alter the fragmentation insert pattern in flight to adapt to rapidly changing battlefield conditions. For example, the warfighter could deploy a warhead configured to neutralize enemy personnel using smaller fragments and then remotely change the warhead's insert pattern in flight to defeat vehicles with larger fragments as the enemy combatants seek cover.

It will be appreciated that this variable lethality warhead enhances the U.S. military's capabilities by: optimizing lethality; minimizing collateral damage; engaging expanded target sets with more efficient munitions; enabling multi-mission capability using a single warhead; reducing the costly burden on supply and logistics; facilitating new warhead development using lower cost, commonly available steels and simple, inexpensive manufacturing techniques.

OBJECTS OF THE INVENTION

Accordingly, it is an object of the present invention to provide a fragmentation warhead for a projectile in which fragment size can be field pre-selected by the warhead user.

Another object of the present invention is to provide a fragmentation warhead for a projectile which includes a preselection hand twistable fuze to change desired warhead fragmentation from large to small fragment size.

It is a further object of the present invention to provide a preselectable fragment size fragmentation warhead which can be used for grenades, for mortars, as well as for artillery projectiles.

It is a yet another object of the present invention to provide a preselectable fragment size fragmentation warhead which can be changed during flight by telemetry, to select fragment size desired upon detonation.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
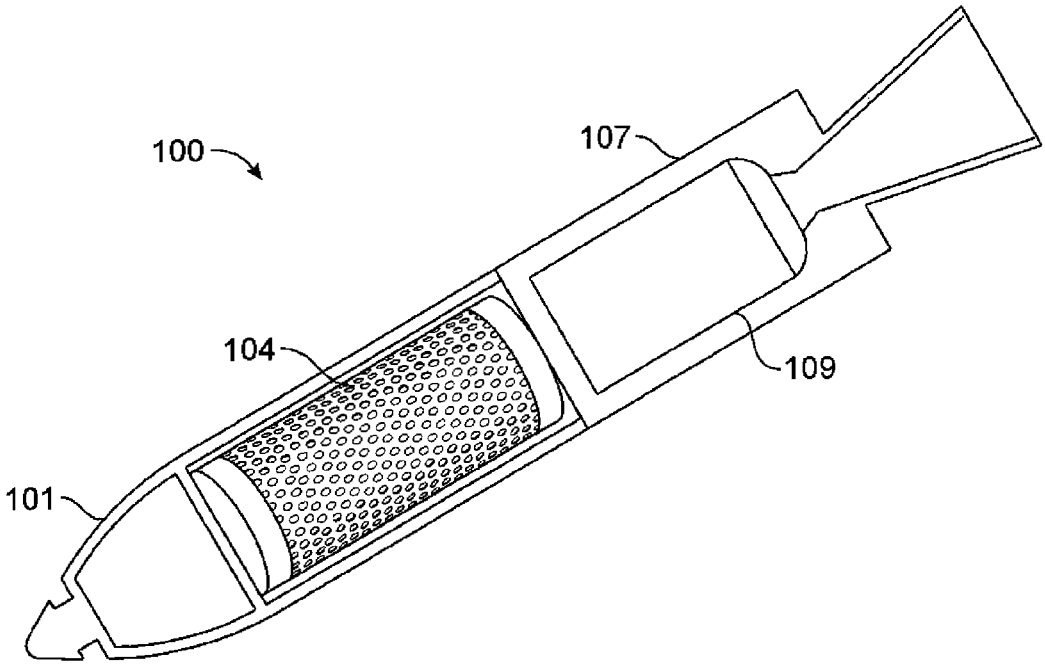
FIG. 1 shows a round of ammunition that may employ this invention.
Figure 2:
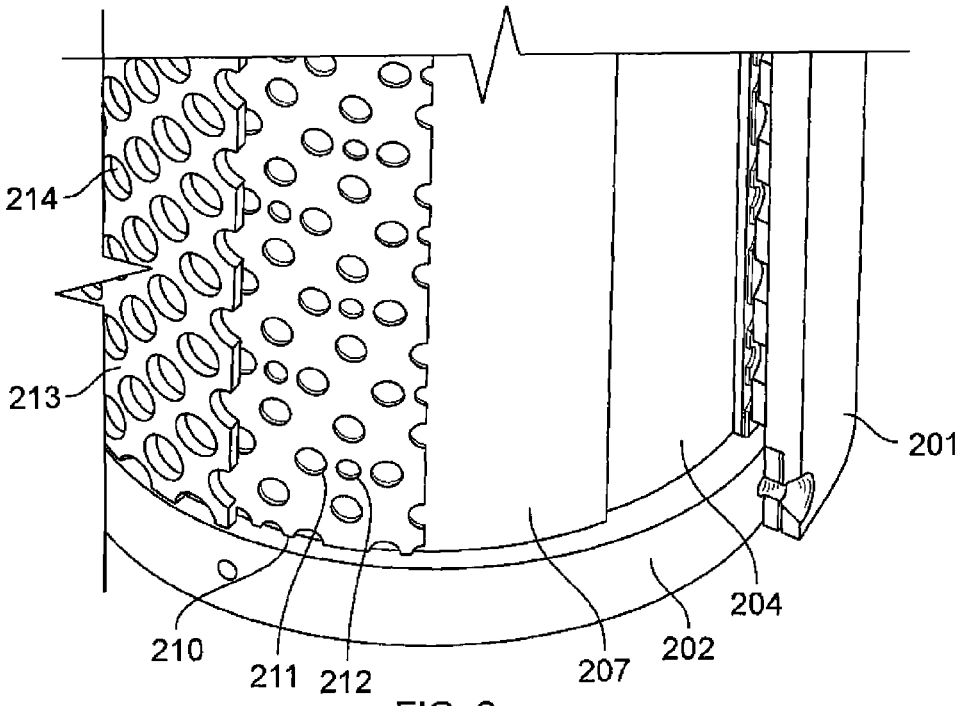
FIG. 2 shows the warhead section of the round in FIG.1, in enlarged partial cutaway views according to the invention.
Figure 3:
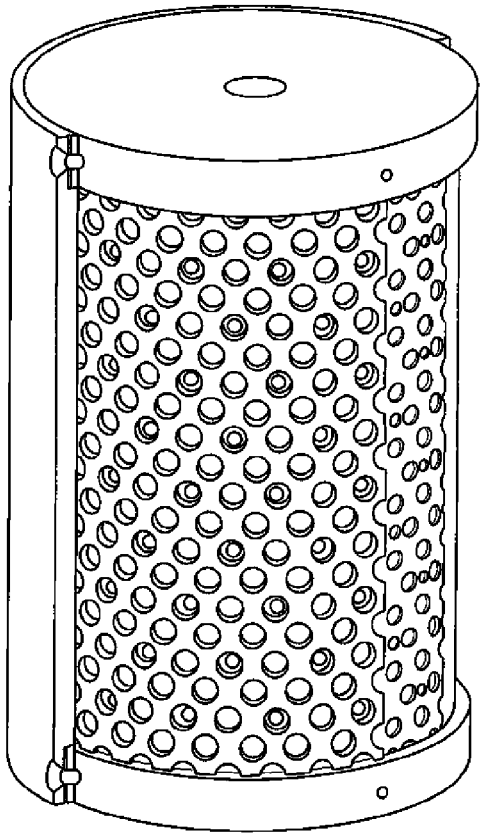
FIG. 3 shows a configuration of the warhead of FIG. 2 to line up holes in the liners which will lead to larger sized fragments when the warhead detonates, according to the invention.
Figure 4:
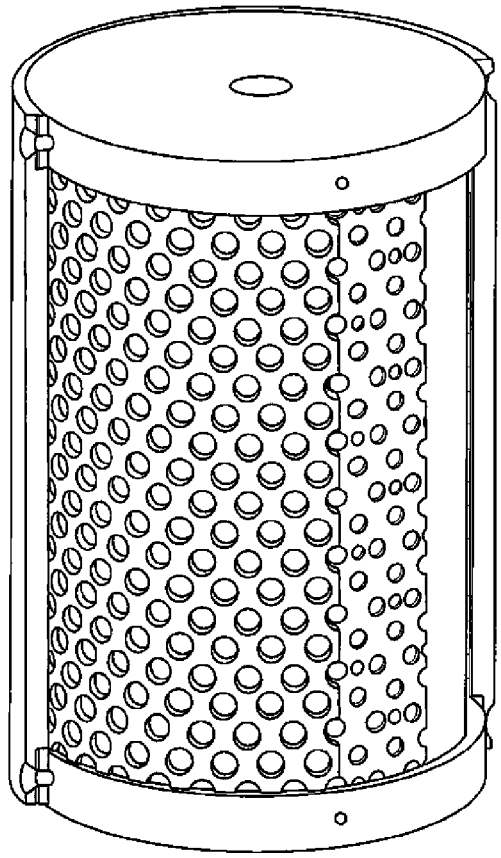
FIG. 4 shows a configuration of the warhead of FIG. 2 to line up holes in the liners which will lead to smaller sized fragments when the warhead detonates, according to the invention.
Figure 5A:
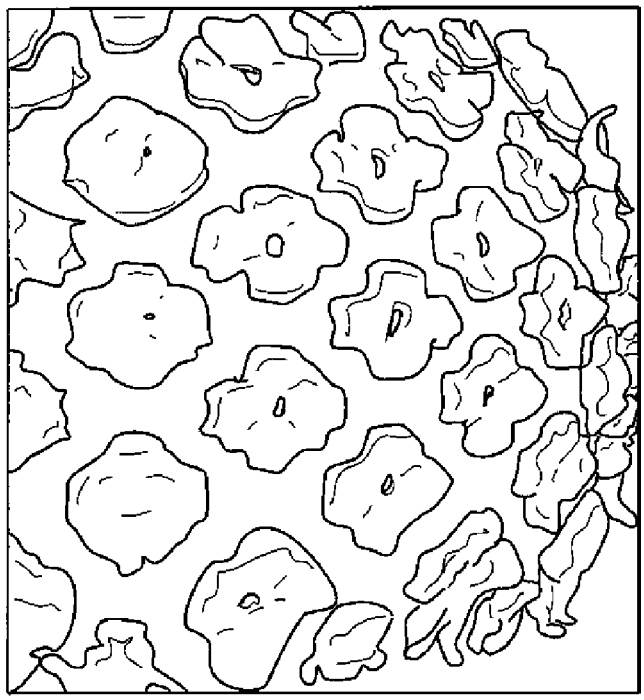
FIG. 5A shows exemplars of larger sized fragments resulting from FIG. 3 configuration of the warhead according to the invention.
Figure 5B:
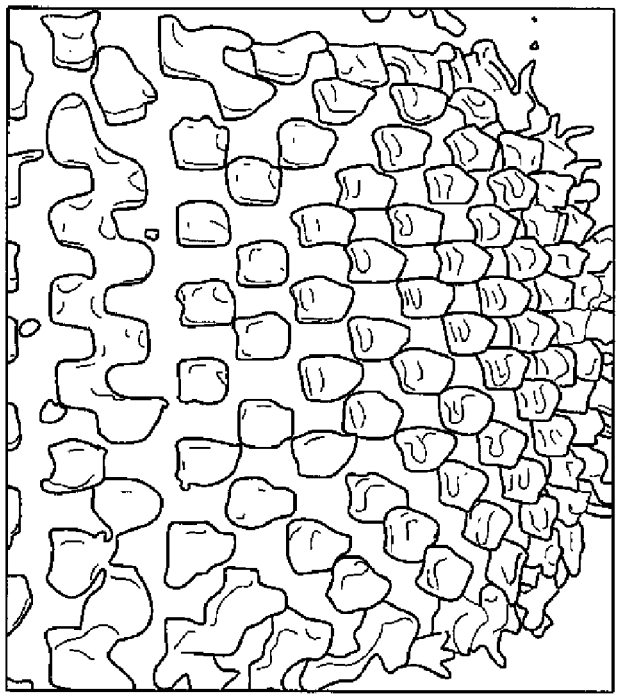
FIG. 5B shows exemplars of smaller sized fragments resulting from FIG. 4 configuration of the warhead according to the invention.

In FIG. 1, there is shown a subject round 100 which might employ the invention. Round 100 has a fore section 101, an aft section 107, and a propulsion means 109. Behind the fore section is a warhead 104 section, which warhead includes this invention. Warhead 104 is shown in enlarged partial cutaway views in FIG. 2. A pair of circular shaped base elements 202 serve as bookends, in between which are mounted several cylindrically shaped elements. These begin innermost with a more or less solid cylindrically shaped (explosive billet), main charge 204. Next surrounding the main charge 204 is a more or less hollow cylindrical sheet metal shield 207(an explosive containment sleeve). Next surrounding the metal shield 207 is a more or less hollow cylindrical sheet metal inner sleeve 210. Inner sleeve has a first pattern of relatively small holes 212 punched there through (which holes may be of equal size to one another, or not), and a second pattern of relatively larger holes 212 punched there through (which may be of equal size to one another, or not). Next surrounding the inner sleeve 210 is a (rotatable relative to inner sleeve 210) more or less hollow cylindrical sheet metal outer sleeve 213, which has a third pattern of holes 214 punched there through, the holes 214 usually all about the same diameter with respect to one another and usually of diameter at least as large as the bigger holes 211 of inner sleeve 210. The third pattern of holes 214 on outer sleeve 213 are such that outer sleeve 213 may be rotated around inner sleeve 210 to line up holes 214 with either the smaller holes 212 of the inner sleeve 210, or with the larger holes 211 of the inner sleeve 210, but not usually with both sized holes at the same time. However, it may be wished to combine lining up of either some combination of, or both sized of the holes, in some other application. A more or less hollow cylindrically shaped outer shell casing 201 surrounds outer sleeve 213. In operation, the lining up of holes 214 with holes 211 (see FIG. 3) is expected to lead to larger sized fragments (one exemplary shape as shown in FIG. 5A), whereas the lining up of holes 214 with holes 212 (see FIG. 4) is expected to lead to smaller sized fragments (another exemplary shape as shown in FIG. 5B), when the main charge 204 is detonated and ultimately fragments the shell casing 201 into pieces. The purpose of explosive containment shield 207 is to equally spread the detonation energy.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A selectable fragment size warhead for a projectile comprising:

a pair of circular shaped base elements in between which are mounted:

a cylindrically shaped main charge;

an axially concentric hollow cylindrical shield surrounding said main charge;

an axially concentric hollow cylindrical inner sleeve surrounding said shield;

an axially concentric hollow cylindrical outer sleeve surrounding said inner sleeve, said outer sleeve and inner sleeve axially rotatable relative to one another;

an axially concentric hollow shell casing surrounding said outer sleeve;

said inner sleeve having a first pattern of relatively small holes, and a second pattern of relatively larger holes, there through;

said outer sleeve having a third pattern of holes, of diameter equal to the holes in said second pattern, there through;

whereby said outer sleeve and said inner sleeve may be rotated axially with respect to one another to selectively expose either said first pattern holes or said second pattern holes, to show through the holes of said third pattern on said outer sleeve;

whereby said shell casing is exploded into fragments when the main charge is detonated, the fragment size influenced by alignment of the third pattern holes with either the first pattern holes or the second pattern holes, alignment to first pattern holes leading to smaller sized fragments while alignment to second pattern holes leading to larger sized fragments.

2. The warhead of claim 1 where the fragmentation mode can be selected in the field easily and reliably by simply rotating the sleeves through a fuze assembly on the warhead.

3. The warhead of claim 2 where a selection default position is the setting for producing large fragments, to be used against vehicular targets.

4. The warhead of claim 3 where a setting for smaller fragments against personnel targets may be selected.

5. The warhead of claim 2 where larger sized fragments are for vehicle targets.

6. The warhead of claim 3 where smaller sized fragments are for personnel targets.

7. The warhead of claim 1 where the liners are made of cylindrical sheet metal with the holes punched there through.

8. The warhead of claim 1 where the projectile is a mortar ammunition.

9. The warhead of claim 1 where the projectile is an artillery round.

10. The warhead of claim 1 where the warhead is used in a grenade.

* * * * *